US005667832A

United States Patent [19]

Tromans

[11] Patent Number: 5,667,832

[45] Date of Patent: Sep. 16, 1997

[54] METHOD AND DEVICE FOR FOAM GENERATION BY DISPERSION OF BUBBLES

[75] Inventor: Keith Tromans, Sutton Coldfield, England

[73] Assignee: Scottish and Newcastle PLC, Edinburgh, United Kingdom

[21] Appl. No.: 658,018

[22] Filed: Jun. 4, 1996

Related U.S. Application Data

[63] Continuation of Ser. No. 232,218, filed as PCT/GB92/02048, Nov. 5, 1992, and published as WO93/09055, May, 13, 1993, abandoned.

[30] Foreign Application Priority Data

| | | | |
|---|---|---|---|
| Nov. 5, 1991 | [GB] | United Kingdom | 9123451 |
| Dec. 17, 1991 | [GB] | United Kingdom | 9126702 |
| Mar. 25, 1992 | [GB] | United Kingdom | 9206483 |

[51] Int. Cl.[6] ..... B65B 25/00; B65B 31/00

[52] U.S. Cl. ..... 426/394; 426/112; 426/115; 426/124; 426/131; 426/398; 426/477; 426/106; 222/424.5; 222/442; 222/481.5; 220/203.01; 220/203.03; 220/714; 137/170.2; 137/170.4; 137/170.6; 206/216; 261/DIG. 7

[58] Field of Search ..... 426/77, 112, 115, 426/124, 131, 394, 398, 477, 106; 261/124, DIG. 7; 141/64, 82; 206/216; 222/424.5, 442, 481.5, 399; 220/203.01, 203.03, 714; 137/170.2, 170.4, 170.6

[56] References Cited

U.S. PATENT DOCUMENTS

| | | | |
|---|---|---|---|
| 2,794,579 | 6/1957 | McKernan | 222/399 |
| 3,039,644 | 6/1962 | Lefcort | 426/120 X |
| 3,243,085 | 3/1966 | Wilson | 222/399 X |
| 3,258,163 | 6/1966 | Brush | 222/399 X |
| 3,513,886 | 5/1970 | Easter et al. | 426/115 |
| 3,613,954 | 10/1971 | Bayne | 222/399 X |
| 3,815,793 | 6/1974 | Morane et al. | 222/399 |
| 3,995,778 | 12/1976 | Gamadia | 222/399 |
| 4,060,956 | 12/1977 | Goble | 426/397 X |
| 4,518,082 | 5/1985 | Ye | 426/124 X |
| 4,518,103 | 5/1985 | Lim et al. | 426/120 X |
| 4,524,078 | 6/1985 | Bardsley et al. | 426/112 |
| 4,627,986 | 12/1986 | Bardsley et al. | 426/112 |
| 4,832,968 | 5/1989 | Forage et al. | 426/112 |
| 4,995,218 | 2/1991 | Byrne | 426/115 X |
| 4,995,533 | 2/1991 | Vandoninck | 222/399 X |
| 4,996,823 | 3/1991 | Byrne | 426/115 X |
| 5,009,901 | 4/1991 | Byrne | 426/112 |
| 5,029,733 | 7/1991 | Hedderick et al. | 261/DIG. 7 X |

(List continued on next page.)

FOREIGN PATENT DOCUMENTS

| | | | |
|---|---|---|---|
| 360375 | 3/1990 | European Pat. Off. . | |
| 1160024 | 12/1963 | Germany . | |
| 1066508 | 4/1967 | United Kingdom . | |
| 1266351 | 3/1972 | United Kingdom . | |
| 1588624 | 4/1981 | United Kingdom . | |
| 2268151 | 1/1994 | United Kingdom | 426/112 |
| 9324384 | 12/1993 | WIPO | 426/112 |

*Primary Examiner*—Milton Cano
*Attorney, Agent, or Firm*—Reid & Priest

[57] ABSTRACT

A method and apparatus for the generation of a foaming dispersion of bubbles in a carbonated beverage or other gas-containing liquid packaged in a can (120) or other sealed container. An initially liquid-free device (9) having an internal chamber with an inlet/outlet valve (130/150) assembly is placed in the can, which is then filled with the beverage. The can is sealed and pasteurized, which raises the internal pressure in the can to force some of the gasified beverage into the device through the inlet valve. The outlet valve holds the quantity of beverage in the internal chamber until the can is opened, whereupon the depressurization of the can opens the outlet valve to discharge the internal chamber through an orifice to initiate seed bubbles which form a head on the beverage. The method and apparatus are particularly applicable to producing a head on fermented alcoholic beverages to simulate draught beverages.

24 Claims, 7 Drawing Sheets

U.S. PATENT DOCUMENTS

| | | | |
|---|---|---|---|
| 5,062,548 | 11/1991 | Hedderick et al. | 261/DIG. 7 X |
| 5,196,216 | 3/1993 | Lynch et al. | 426/112 |
| 5,231,816 | 8/1993 | Lynch et al. | 53/432 |
| 5,334,400 | 8/1994 | Pudham | 426/112 |
| 5,340,595 | 8/1994 | Cameron-Price | 426/112 |
| 5,466,473 | 11/1995 | Forage et al. | 426/115 |
| 5,514,393 | 5/1996 | Lynch et al. | 426/115 X |
| 5,552,168 | 9/1996 | Cameron-Price | 426/115 X |

METHOD AND DEVICE FOR FOAM GENERATION BY DISPERSION OF BUBBLES

This is a continuation of U.S. patent application Ser. No. 08/232,218, filed as PCT/GB92/02048 Nov. 5, 1992 and published as WO93/09055 May 13, 1993, now abandoned.

This invention relates to a device and a method for generation of a foaming dispersion of bubbles within a beverage or other liquid packaged within a sealed, non-resealable can or other container, and to a beverage package incorporating a beverage frothing device. This invention is especially although not exclusively suited to use with canned alcoholic beverages such as beer, ale, porter, stout or lager, but may also be used with non-alcoholic "soft" drinks.

A device and method for the production of a foamy dispersion of bubbles or "head" is desirable in canned beverages such as beer, ale, porter, stout or lager since these beverages tend to have a diminished head when dispensed from a can, in comparison to beverages dispensed on draught. Head generation is assisted by the release of gas dissolved in the beverage when it is depressurised whether by being drawn from a keg as with draught beverage, or by the opening of a can or bottle. In draught beverages this head generation is enhanced by the pressurisation of the kegs with carbon dioxide ($CO_2$), nitrogen ($N_2$) or other suitable inert gases, combined with the use of foaming devices in the dispense equipment. Thus draught beverages usually release more bubbles during depressurisation caused by dispensing and have more dense, longer lasting heads than beverages dispensed from cans or bottles.

Prior art has addressed these problems by various methods.

Disclosure has been made of various moulded inserts which are wholly or partially gas-filled and discharge their gas (or gas and beverage) through an orifice in the insert upon depressurisation of the can. The energy released from the insert upon depressurisation may be temperature sensitive causing inconsistent head production at varying temperatures. At room temperature this may result in excessive foaming, spillage and loss of beverage.

Alternative approaches to the problem include cans modified to comprise one chamber for beverage and one for gas that mixes with the beverage when the can is opened. This sophisticated design of can leads to high costs and could prove commercially unviable.

Various intermediate systems have been proposed wherein gas chambers are incorporated in can lids or bases. In addition chemical methods of inducing a head have been disclosed but it is unclear to what extent these affect the taste of the beverage.

According to a first aspect of the present invention there is provided a device for generating a foaming dispersion of bubbles in a fluid surrounding the exterior of said device, said fluid comprising a liquid having gas dissolved therein, said device comprising an internal chamber provided with valve means adapted to admit some of said fluid surrounding said exterior of said device through said valve means and into said chamber when the pressure of said surrounding fluid exceeds the internal pressure of said chamber by a first predetermined amount, thereby to establish a reserve of pressurised fluid within said chamber, said valve means being further adapted to release said reserve of pressurised fluid from said chamber to pass outwardly via orifice means into said fluid surrounding said exterior of said device when said internal pressure of said chamber exceeds the pressure of said surrounding fluid by a second predetermined amount, said orifice means being dimensioned to cause the outward passage of fluid therethrough to generate a foaming dispersion of bubbles in said surrounding fluid.

The generation of said foaming dispersion of bubbles in said surrounding fluid is preferably brought about in use of said device by so dimensioning said orifice means as to depressurise said fluid passing outwardly through said orifice means in a manner which causes the gas dissolved in said liquid to come out of solution in the form of a plurality of foam-generating seed bubbles.

Said valve means may comprise functionally separate inlet valve means and outlet valve means respectively adapted for the admission and release of fluid to and from said chamber.

Said inlet valve means may comprise a poppet valve or a flap valve, or more preferably a one-way fluid valve as described in British Patent Specification GB1066508.

Said inlet valve means may alternatively comprise a diaphragm having at least one slit therein, said diaphragm partly bounding said chamber and being substantially closed to the outward passage of fluid therethrough, said diaphragm being inwardly deformable by external pressure to open said at least one slit for the passage therethrough of fluid into said chamber.

Said outlet valve means may comprise a poppet valve or a flap valve, or more preferably a differential valve which may have the form of an outer passage normally closed by a plug having a chamber-facing inner area acted upon by the internal pressure of said chamber, said plug further having an exterior-facing outer area acted upon by the pressure of said fluid surrounding the exterior of said device, said outer area being greater than said inner area by an extent which maintains said outlet passage plugged until said internal pressure of said chamber exceeds the pressure of said surrounding fluid by said second predetermined amount thereupon to cause or allow said outlet passage to come unplugged to release said reserve of pressurised fluid from said chamber. Said differential valve is preferably such that upon said outlet passage becoming unplugged, said outlet passage remains unplugged and does not become replugged by subsequent pressure changes.

According to a second aspect of the present invention there is provided a method of generating a foaming dispersion of bubbles in a fluid, said fluid comprising a liquid having gas dissolved therein, said method comprising the steps of providing a device according to the first aspect of the present invention, submerging said device in said fluid to surround the exterior of said device with said fluid, pressurising said surrounding fluid above the internal pressure of said chamber in said device by at least said first predetermined amount thereby cause some of said surrounding fluid to be admitted through said valve means of said device and into said chamber to establish a reserve of pressurised fluid within said chamber, maintaining said device submerged in said fluid and maintaining the pressurisation of said fluid surrounding the exterior of said device above the initial pressure thereof by an amount that substantially obviates premature discharge of a substantial proportion of said reserve of pressurised fluid from said device, said pressurisation of said surrounding fluid being maintained until the generation of a foaming dispersion of bubbles is required and thereupon depressurising the fluid surrounding the exterior of said device to a pressure below the internal pressure of said chamber by at least said predetermined second amount to cause the outward passage of said reserve of fluid through said orifice means whereby to generate a foaming dispersion of bubbles in said surrounding fluid.

According to a third aspect of the present invention there is provided a method of packaging a beverage in a sealed container for the subsequent generation of a foaming dispersion of bubbles in said beverage upon said container being unsealed, said beverage comprising a liquid having gas dissolved therein, said method comprising the steps of providing a sealable container which is initially open, unsealed and empty of liquid; providing a device according to the first aspect of the present invention; emplacing said device in said open container; prior or subsequent to the emplacement of said device in said open container, adding a quantity of said beverage to said open container sufficient to submerge said device when emplaced in said container and to surround the exterior of said device with said beverage; closing and sealing said container with said quantity of beverage and said submerged device therein; and temporarily elevating the temperature of at least the contents of said closed and sealed container by an amount to cause a concomitant increase in the pressure of said beverage surrounding said device sufficient to cause some of said beverage to be admitted through the valve means of said device and into the internal chamber of said device to establish a reserve of pressurised beverage within said chamber, whereby when said container is subsequently unsealed and opened, said beverage surrounding the exterior of said device emplaced in said container depressurises towards ambient atmospheric pressure and the pressure of this beverage falls by at least said second predetermined amount below the internal pressure in said chamber of said device due to the beverage reserved therein thereby to initiate the discharge of said reserved beverage from said internal chamber of said device outwardly through said orifice means of said device and into said surrounding beverage to generate a foaming dispersion of bubbles in said surrounding beverage to tend to form a head on said beverage.

At least the internal chamber of said device is preferably purged of oxidising gases prior to emplacement thereof in said container, for example by displacing air initially present in said device with a suitable non-oxidising gas which may be nitrogen, carbon dioxide, or a mixture of these gases. Said container is preferably likewise purged of oxidising gases before the addition thereto of said quantity of beverage.

Said temporary elevation of the temperature of at least the contents of said sealed container is preferably subsumed within a conventional pasteurisation procedure for newly sealed containers of beverage, conveniently by conjointly heating the sealed container and its contents.

According to a fourth aspect of the present invention, there is provided a packaged beverage comprising a closed and sealed container containing a quantity of beverage and a device according to the first aspect of the present invention, said beverage having been packaged in said container by the method according to the third aspect of the present invention.

Said beverage may be an alcoholic beverage which is preferably a fermented beverage containing dissolved carbon dioxide as a product of fermentation, but the beverage may additionally or alternatively comprise ersatz carbonation, for example an injected gas comprising carbon dioxide and/or nitrogen. (Ersatz carbonation is likely to be employed where the beverage is unfermented as in the cases of non-alcoholic "soft" drinks and cocktails of soft drink mixed with distilled alcohol).

Said container is preferably a can which may have a one-piece body of deep-drawn aluminium or steel closed by an initially separate top end disc (preferably also of aluminium or steel) incorporating an integral closure tab defined by coining of the top end disc and attached to a manually operable pull ring for partial or total separation of the tab from the top end disc to unseal and open the filled can, the can being closed and sealed by seaming of the top end disc to the rim of the body.

Embodiments of the present invention will now be described, by way of example, with reference to the accompanying drawings, in which.

Figure 15:
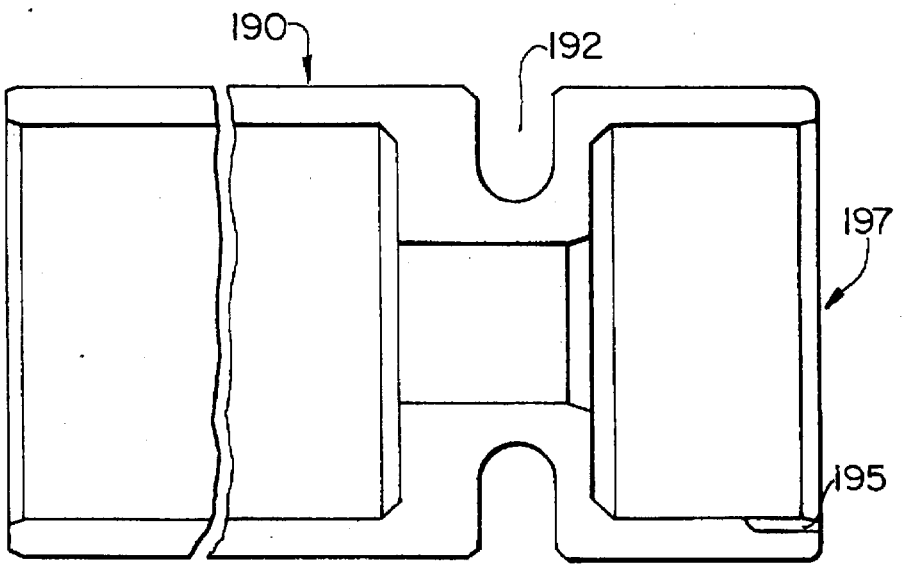
FIG. 15 is a longitudinal section, to an enlarged scale, through a body of the device of FIG. 12.
Figure 16:
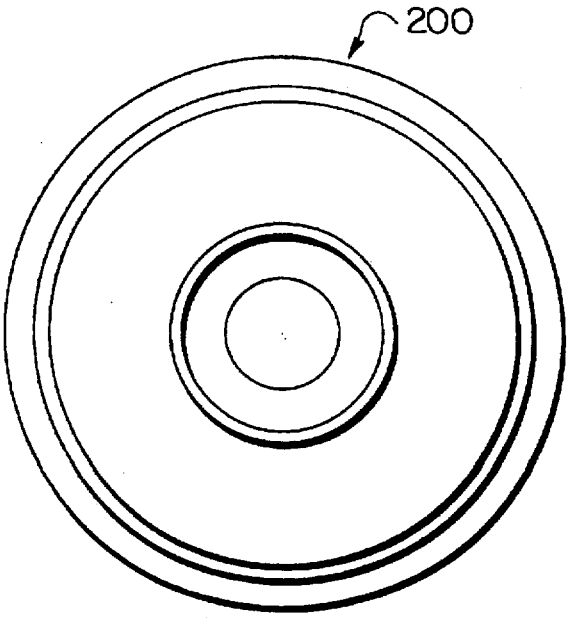
FIG. 16 and 17 are respectively an end view and a longitudinal section of a piston forming part the device of FIG. 12.
Figure 17:
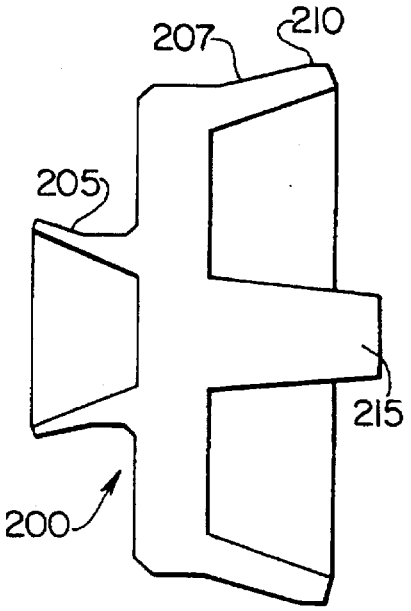
Figure 21:
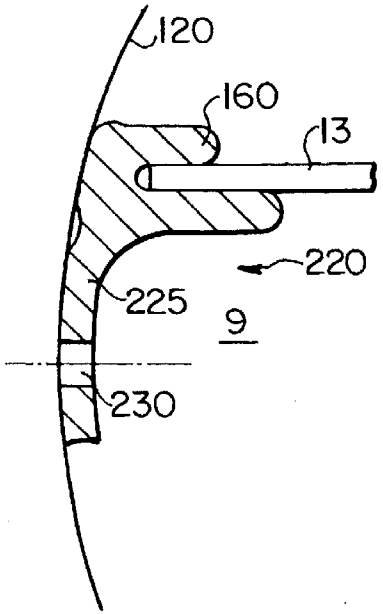
FIG. 21 is a longitudinal section through the valve of FIG. 18, shown here assembled into the fifth embodiment while the device is in a charged state.
Figure 20:
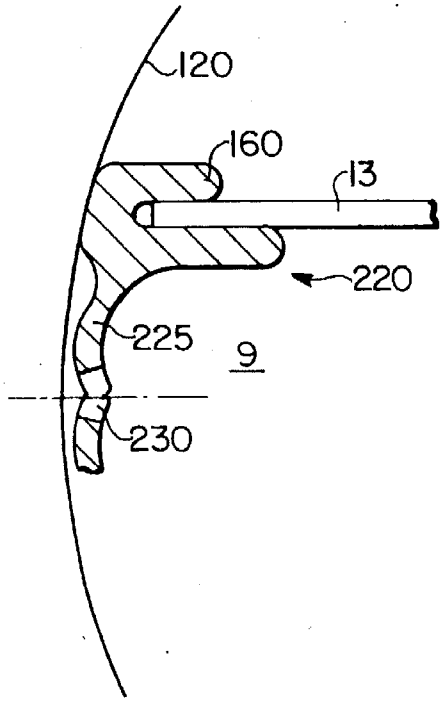
FIG. 20 is a longitudinal section through the valve of FIG. 18, shown here assembled into the fifth embodiment while the device is charging.
Figure 19:
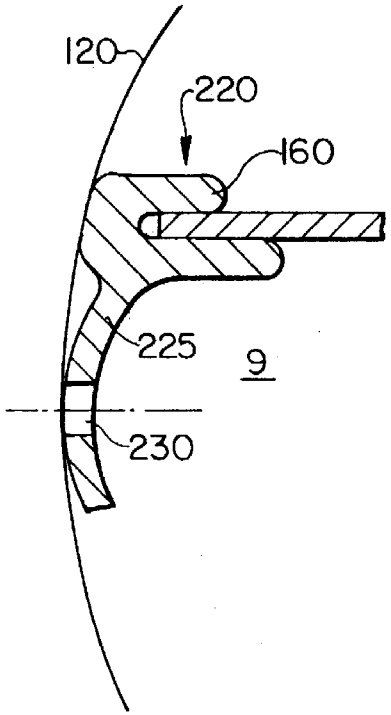
FIG. 19 is a longitudinal section through the valve of FIG. 18, shown here assembled into the fifth embodiment while the device is in pressure equilibrium prior to being charged.
Figure 18:
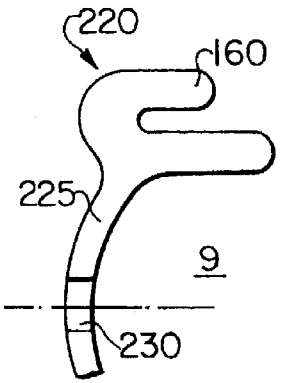
FIG. 18 is a longitudinal section through an inlet valve intended to form part of a fifth embodiment of a device for the generation of a foaming dispersion of bubbles in a beverage.
Figure 22:
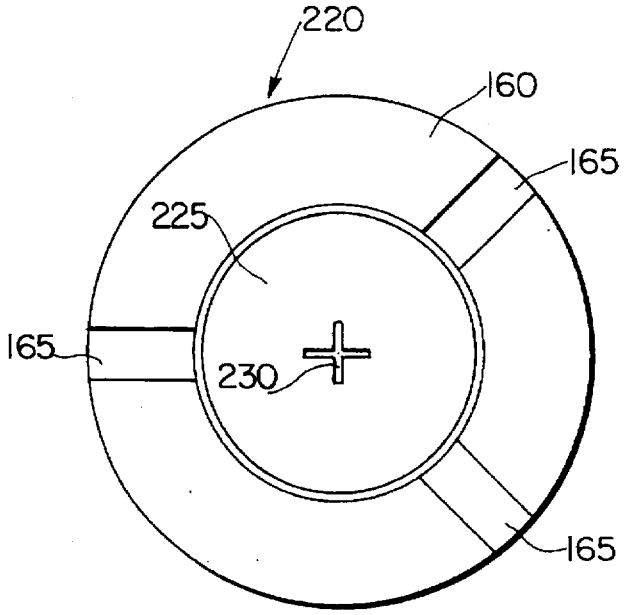
Figure 23:
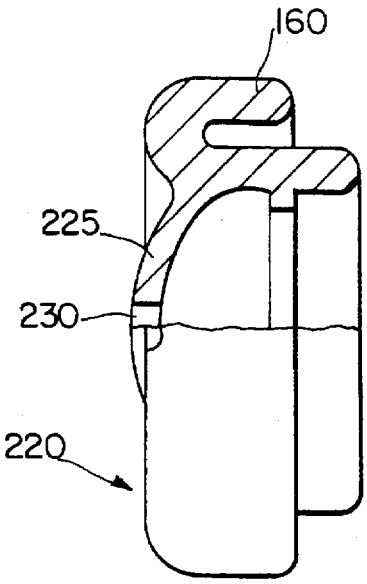
Figure 24:
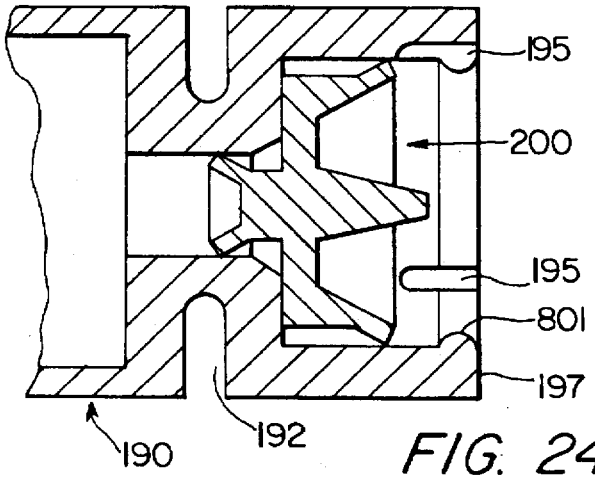
Figure 25:
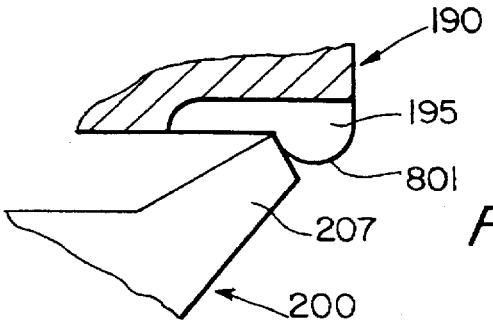

FIG. 22 and 23 respectively show an end view and a half-sectional side view of the valve of FIG. 18;

FIG. 24 is a sectional elevation of an assembly of a modified form of the body and piston of FIGS. 15–17; and FIG. 25 is a fragmentary section, to an enlarged scale, of part of FIG. 24 with the piston displaced along the body relative to the positions shown in FIG. 24.

Figure 1:
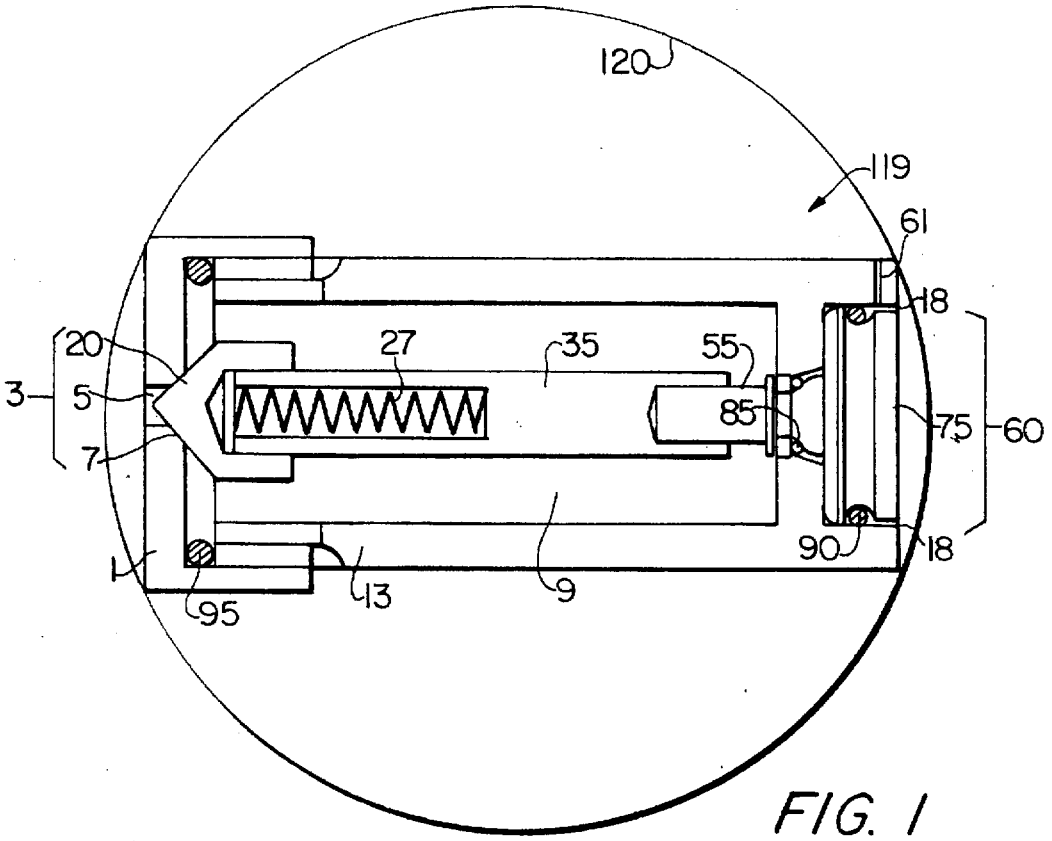
FIG. 1 is a longitudinal section through a first embodiment of a device for the generation of a foaming dispersion of bubbles in a fluid.
Figure 2:
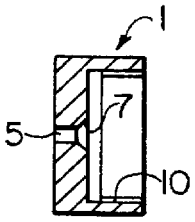
FIG. 2 is a longitudinal section to a reduced scale through an end cap of the device of FIG. 1.
Figure 3:
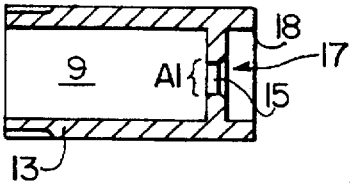
FIG. 3 is a longitudinal section to a reduced scale through the body of the device of FIG. 1.
Figure 4:
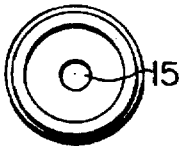
FIG. 4 is an end elevation of the device of FIG. 3.
Figure 5:
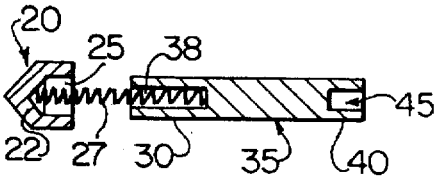
FIG. 5 is a longitudinal section to a reduced scale through an inlet valve and spacer bar assembly in the device FIG. 1.

Referring now to the drawings, FIG. 1 shows, in longitudinal section, a fully assembled device according to a first embodiment of the invention. This first embodiment is a re-usable device particularly intended to demonstrate the operational principles of the present invention (as distinct from the other embodiments which are single-use devices intended to be disposed of along with the single-use disposable beverage cans in which they are incorporated). The device as shown in FIG. 1 has an end cap (see also FIG. 2) having an axial inlet aperture 5 countersunk at 7 to act as the valve seat of a poppet inlet valve assembly 3. The end cap 1 is threaded on an internal surface 10 to co-operate with a corresponding external thread on a wall 13 of a reservoir or internal chamber 9 of the device (see also FIGS. 3 and 4). A male part 20 of the inlet valve assembly 3 (see also FIG. 5) is provided as the movable closure element thereof. One end 22 of the part 20 is conically shaped to be complementary to the valve seat 7 of the valve assembly 3 and normally cooperates with the valve seat 7 to close the inlet aperture 5. The other end of the male part or closure element 20 has a cavity 25 adapted to receive a spring 27 and one end 30 of a spacer bar 35. The end 30 of the spacer bar 35 comprises an axial bore 38 which cooperates with the cavity 25 in the closure element 20 to enclose the spring 27 which biases the closure element 20 firmly against the valve seat 7 of the inlet valve assembly 3, thus closing the valve's inlet aperture 5.

Figure 6:
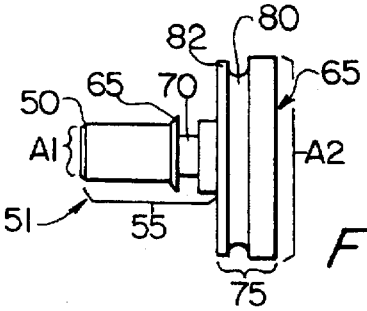
FIG. 6 is a longitudinal section through the plug of an outlet valve of the device of FIG. 1.

The other end 40 of the spacer bar 35 comprises a second axial bore 45 (FIG. 5), of shorter length than the bore 38, and which accommodates one end 50 of a piston extension 55 of a piston assembly 51 (FIGS. 1 and 6). The other end 65 of the piston extension 55 has an annular groove 70 and extends from a piston 75 into which is cut a second annular groove 80. The piston 75 is of a larger diameter than the piston extension 55 and hence the outward-facing area A2 of the piston 75 (see FIG. 6) substantially exceeds the inward-facing area A1 of the piston extension 55. (The functional significance of this area ratio will be explained below).

The device of FIG. 1 is assembled as follows:

The piston extension 55 is inserted into the reservoir 9 through the aperture 15 such that the piston 75 fits into a cylindrical end wall portion 17 of the device. O-ring seals 85 and 90 are fitted contiguously with annular grooves 70 and 80 and with the walls of the aperture 15 and the cylindrical portion 17 respectively to provide sliding seals therebetween. The piston assembly 51, the aperture 15 and the cylindrical port 17 together define an outlet valve assembly 60 for the device of FIG. 1. The piston extension 55 is then slotted into the spacer bar axial bore 45. The spring 27 is located in the cylinder formed between axial bore 38 in the spacer bar 35 and cavity 25 on the closure element 20 of the poppet valve. The end cap 1 is then screwed on to the wall of the reservoir 13 until a right fit is achieved by sufficient pressure on an O-ring seal 95 such that the closure element 20 of the inlet valve assembly 3 engages with the valve seat 7 and is held against it by the force of the spring 27 thus closing the inlet aperture 5. (Operation of the device of FIG. 1 will be described subsequently).

Figure 7:
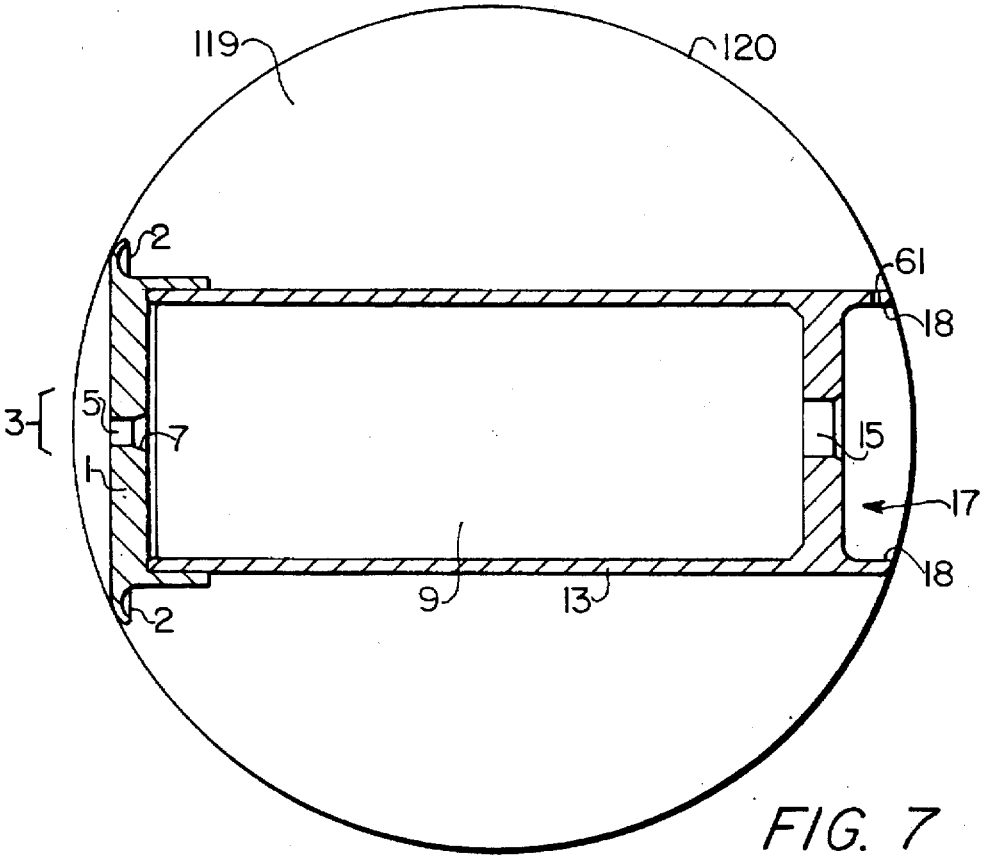
FIG. 7 is a longitudinal section through a partially assembled second embodiment of a device for the generation of a foaming dispersion of bubbles in a beverage.
Figure 8:
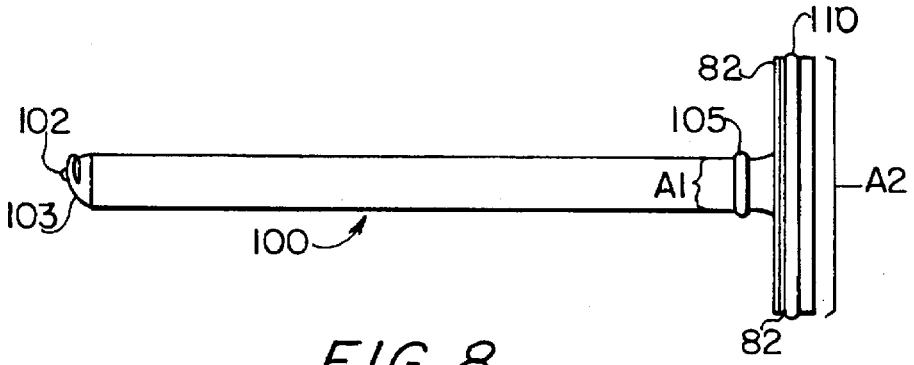
FIG. 8 is a side view of a piston assembly of the device of FIG. 7.
Figure 9:
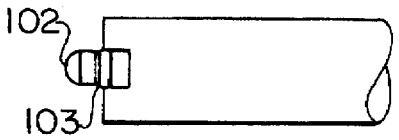
FIG. 9 is a side view to an enlarged scale, of an end of the piston assembly shown in FIG. 8, rotated by 90° around its longitudinal axis.

Referring now to FIGS. 7, 8 and 9, these illustrate a second embodiment of the invention which differs from the first embodiment (described above with reference to FIGS. 1–6) in respect of certain details of its construction. (Parts of the second embodiment which are not significantly different from the first embodiment are given the same reference numerals).

In the second embodiment an end cap 1 is welded ultrasonically onto the device body 13 and includes a pliable circumferential ring 2 which presses both ends of the device against the side wall of a beverage can 119 thereby holding the device firmly in position within the can 119.

A piston assembly 100 of the second embodiment is moulded in a single piece instead of being assembled separately from the separately formed piston 75, spacer bar 35, spring 27 and closure element 20 of the first embodiment. In the second embodiment, the closure element of the inlet valve assembly 3 is provided by a hemispherical protrusion 102 from a hinged plastic spring 103 which provides the force to hold the hemispherical protrusion 102 against the valve seat 7 of the inlet valve assembly 3 thereby closing the inlet aperture 5. The O-ring seals 85 and 90 of the first embodiment are replaced in the second embodiment by moulded seals 105 and 110 respectively (FIG. 8), these seals 105 and 110 being formed during the moulding process employed to form the components of the second embodiment to be continuous with the piston assembly 100. Assembly of the second embodiment is analogous to that of the first embodiment, and operation of the second embodiment will be described below along with that of the first embodiment.

Figure 10:
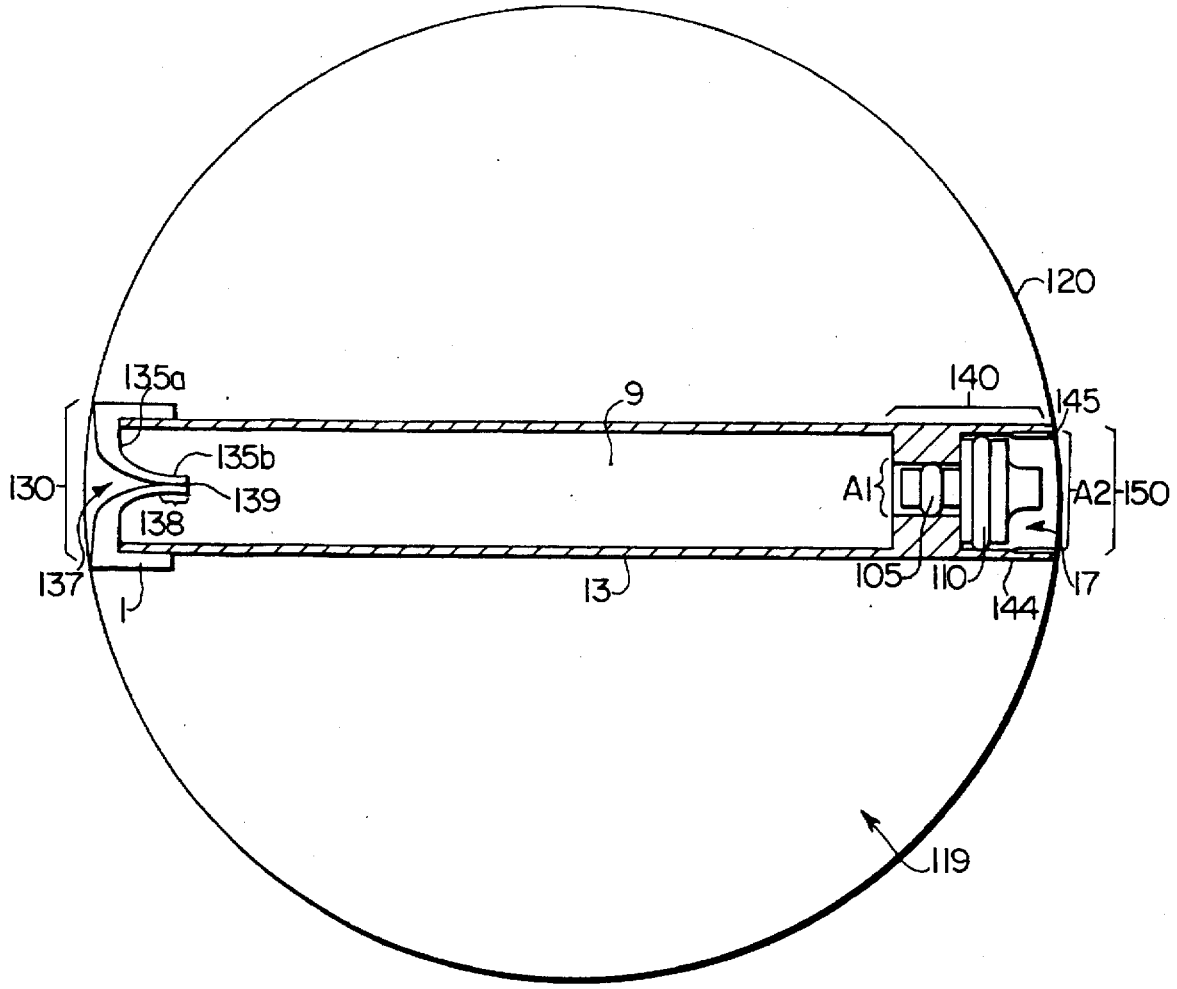
FIG. 10 is a longitudinal section through a third embodiment of a device for the generation of a foaming dispersion of bubbles in a beverage.
Figure 11:
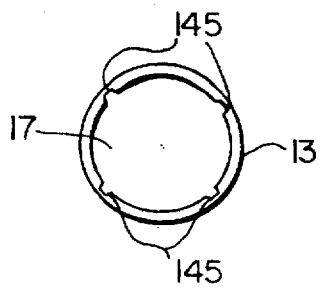
FIG. 11 is a cross section through a cylindrical end portion of the device of FIG. 10.
Figure 12:
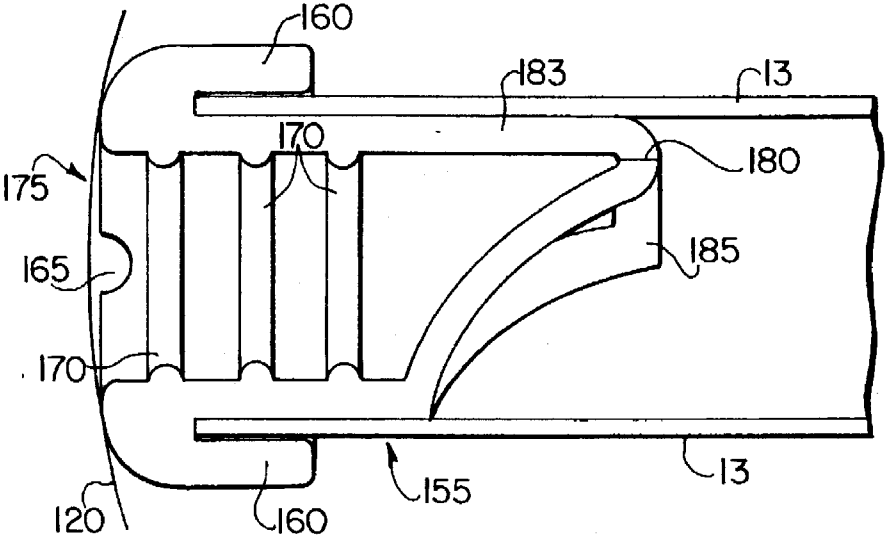
FIG. 12 is a longitudinal section through part of a fourth embodiment of a device for the generation of a forming dispersion of bubbles in a beverage.
Figure 14:
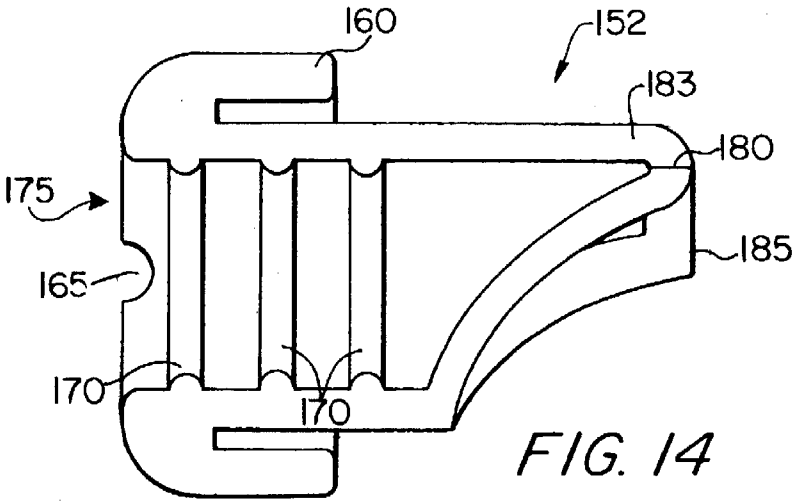
FIG. 14 is a longitudinal section through an inlet valve of the device of FIG. 12.
Figure 13:
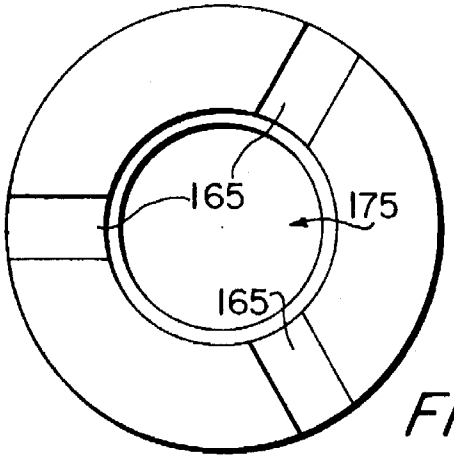
FIG. 13 is an end view of the valve of FIG. 12.

Referring now to FIGS. 10 and 11, these illustrate a third embodiment which differs from the first and second embodiments described above in that the inlet valve assembly 3 of the previous embodiments is replaced by a one-way inlet valve 130 as describe in GB1066508 and sometimes known as a "Woodford valve"). The one-way inlet valve 130 comprises a pliable plastic tube 135 intregal with the end cap 1 and open at each of its ends **135*a* and 135*b*. One end 135*a* of the tube 135 has a circular opening 137 therein which presents negligible resistance to the passage of beverage therethrough. The other end 135*b* of the tube 135 comprises a flattened portion 138 of reduced diameter (in comparison to that of 135*a*) having an opening 139 which consists of a slit in the end 135*b* of the tube 135, the slit opening 139 being perpendicular to the longitudinal axis of, and in the same plane as the flattened portion 138**.

In addition, the third embodiment has a modified outlet valve piston assembly 140 lacking any physical contact with the inlet valve 130 and the single orifice 61 in the wall 13 of the previous embodiments of the device is replaced by four longitudinal exhaust grooves 145 (FIG. 11) on the inner surface of the cylindrical end wall portion 17.

In use of the first or second embodiment of the invention (FIGS. 1–6; FIGS. 7–9), the device is placed across a diameter of an unmodified beverage can prior to filling, sealing and pasteurisation such that the side wall 120 of the can 119 (FIG. 1; FIG. 7) is in contact with the end cap 1 at one end of the device and in contact with the cylindrical portion 17 at the other end. Thus the device is held in position by the force exerted by the pliable circumferential ring (second embodiment only). The device is disposed at the bottom of the can 119 throughout the charging and discharging of the device. The inlet valve assembly 3 requires a pressure differential of approximately one bar to open. Therefore, upon pasteurisation, when the pressure rise in the can 119 (due to the heating of the pasteurisation process) exceeds 1 bar, the inlet valve assembly 3 opens and beverage flows into the reservoir 9 until the pressure therein increases to a level greater than the pressure in the can minus 1 bar (to account for the bias of the spring 27 or 103) at which point the inlet valve assembly 3 closes.

The outlet valve assembly 60 has a high external/low internal area ratio that causes it to remain closed at high internal/low external pressure differentials. The value of this differential is dependent on the area ratio such that $P_1A_1<P_2A_2$ where $P_1$ and $A_1$ are the internal pressure and area respectively and $P_2$ and $A_2$ are the external pressure and area respectively. Therefore, increases in the pressure differential above the given value result in outward movement of the piston assembly 51 or 100 until the orifice 61 is exposed allowing efflux of beverage therethrough. This efflux continues until the pressure differential is eliminated. Thus a generally constant pressure differential is maintained within the reservoir 9, the value of which can be selected by varying the internal/external area ratio of the outlet valve assembly 60.

Upon depressurisation of the can 119 by opening, the pressure of the beverage in the can 119 decreases very rapidly and this alters the force balance across the outlet valve assembly 60. The pressure in the reservoir 9 then causes outward movement of the piston assembly 51 or 100 and exposure of the orifice 61. The outward movement of the piston assembly 51 or 100 is restrained by the wall 120 of the can 119 such that the escape of the beverage/gas mixture is through the orifice 61 or the small annular gap in the outlet valve assembly 60 between the chamfered rim 18 of the cylindrical portion 17 and the chamfered rim 82 of the piston assembly 51 or 100. This provides the seed bubbles necessary for head generation in the beverage.

In use of the third embodiment of the invention (FIGS. 10 and 11), the device is placed in a can 119 as described for the first and second embodiments. As the pressure in the can 119 rises due to pasteurisation, beverage flows into the reservoir 9 through the inlet valve 130 until the pressure in the reservoir 9 increases to a level at which the pressure therein equals the pressure in the can minus the small amount of pressure required to open the inlet valve 130, at which point the inflow of beverage stops. Increases in the pressure in the reservoir 9 above the pressure in the can cause the walls of the flattened portion 138 to be compressed together thus closing the opening 139 and preventing efflux of beverage tough the inlet valve 130.

Increases in the internal/external pressure differential above a given value determined by the internal/external area ratio of the outlet valve assembly 150 as described above result in outward movement of the piston assembly 140 until the seal 110 passes the opening 144 of the grooves 145 allowing the excess pressure within the reservoir 9 to escape therethrough.

Upon depressurisation of the can 119 by opening, the pressure of the beverage in the can 119 decreases very rapidly, upsetting the force balance across the outlet valve assembly 150. The pressure in the reservoir 9 then causes outward movement of the piston assembly 140 and allows escape of beverages gas mixture from the reservoir 9 through the grooves 145. The outward movement of the piston assembly 140 is restrained by the wall 120 of the can 119 such that the escaping beverage/gas mixture is forced through the grooves 145 and this initiates the seed bubbles necessary for head generation in the beverage held in the can 119.

Referring now to FIGS. 12 to 17 inclusive, a fourth embodiment of the foam-generating device of the present invention has an inlet valve 152 of elastomeric material such as rubber. The inlet valve 152 is fitted onto one end 155 of the reservoir wall 13. A return lip 160 seals the inlet valve 152 onto the wall 13 and this seal is enhanced by the compression applied to the device by the can wall 120. The compliance of the valve 152 due to the elastomeric material allows up to a 1% change in the can diameter during thermal cycling without affecting the valve 152. The compressive force on the valve 152 is increased by the charge forces on the device causing it to expand. Thus the compliance of the valve 152 allows the device to overcome the mechanical changes occurring in charging of the device, and in handling and storage of the filled cans.

Three reliefs 165 in the face of the inlet valve 152 allow liquid to pass between the valve 152 and the can wall 120.

Circumferential ribs 170 on the valve 152 are provided to increase resistance to collapse of the valve 152 under pressure when the device is charged.

Beverage (or other gas-containing liquid) enters the inlet valve 152 through the open end 175 and passes through an orifice in the other end of the valve 152. The orifice comprises a slit 180 between two walls of elastomeric material 183, 185. The slit 180 opens against the compressive force between walls 183 and 185 in response to increase in pressure outside the device and allows influx of fluid. When the external/internal pressure differential across the valve 152 is insufficient to open the slit 180, the wall 185 is pressed against wall 183 and the slit 180 is closed.

Thus the valve 180 admits fluid when the external/internal pressure differential across the valve is sufficient to overcome the compressive force of wall 185 against wall 183. Fluid thus admitted cannot escape back through the slit 180 since pressure increases in the device increase the compressive force of wall 185 against wall 183, enhancing the seal on the slit 180.

The device body 190 (FIG. 15) has an annular groove 192 in the outer surface for assembly, handling and insertion purposes and also for isolating the seal from the flexure of the body 190 when under pressure. The body 190 has three longitudinal exhaust grooves 195 in one end 197 for exhaust of pressurised fluid from the device.

The fourth embodiment has an outlet valve assembly comprising a differential piston 200 (FIGS. 16 and 17) having pressure-energised inner and outer seals 205, 207 which can expand to accommodate the full range of moulding tolerance. Inner seal 205 has a cup form whereby fluid pressure on the inner face of the piston 200 will produce a force reaction. Part of the force produced by the internal pressure acts radially to expand the seal 205 and part acts axially to push the piston 200 out of the bore when the device discharges. As the pressure in the device rises, the radial component will increase to form a sealing force which balances the pressure.

On the outer seal 207 (which also has a cup form), a lower sealing force is used than in the inner seal 205 to reduce friction and a small chamfer 210 at the rim of the seal 207 is provided to obviate mechanical jamming of the piston 200.

A protrusion 215 acts as a stroke-limiting end stop for the piston 200 and also provides a convenient pick up point when handling the component thereby reducing handling damage to the seals 205, 207.

Prior to assembly of the fourth embodiment, the body 190 and the piston 200 are handled by the slot 192 and the protrusion 215 respectively. The components are purged with nitrogen and the piston 200 is then inserted into the body 190, followed by the inlet valve 152. This seals both ends and displaces a proportion of the volume of the device, thereby establishing a positive pressure in the nitrogen. This prevents oxygen ingress and increases the pressure of stored gas to be released in discharge upon the can being opened, thereby enhancing foam-generating performance.

In use, the fourth embodiment is placed across a diameter of the can 119 and is held in place by the force reaction of the elastomeric inlet valve 152. The device admits fluid through the inlet valve 152 when the pressure outside the device is sufficient to open the slit 180 against the force of the wall 185 and the pressure inside the device.

Beverage (or other gas-containing liquid) is thus admitted into the device and the pressure inside the device increases to a level determined by the internal/external area ratio of the differential piston 200 of the outlet valve as described for previous embodiments.

Upon opening of the can, the fourth embodiment of device initiates seed bubbles in accordance with a mechanism similar to that described for the third embodiment.

Referring now to FIGS. 18 to 23 inclusive, the fifth embodiment of device shown is similar to the fourth embodiment, but with an alternative inlet valve 220. The inlet valve 220 is constructed from an elastomeric material such as rubber and comprises a diaphragm 225 stretched across one end of the device body 190, the valve 220 having a cross-shaped slit 230 in the centre of the diaphragm 225, a return lip 160, and three inlets 165 as previously described. The device is inserted across a diameter of the can and the physical compression of the elastomeric material at the valve 220 creates a force which retains the device in position.

At pressure equilibrium the diaphragm 225 is distended against the can wall 120 thereby closing and sealing the slit 230 until the pressure outside the device rises due to the pasteurisation process. When the external/internal pressure differential increases beyond a predetermined level, the diaphragm 225 deflects and fluid is admitted through the slit 230, thereby compressing the gas in the reservoir 9.

When peak pasteurisation pressure in the can is reached, inflow of beverage to the device stops. With the establishment of this pressure balance, the elastic energy in the diaphragm 225 causes it to distend against the wall 120 of the can and the slit 230 is sealed. Thus, the slit 230 remains sealed at high internal/low external pressure differentials across the valve 220 and increasing pressure differentials force the diaphragm harder against the wall 120 of the can, thereby enhancing the seal of the slit 230.

The process of discharge of the fifth embodiment of device upon the can being opened is similar to that described for the fourth embodiment.

Since all the embodiments described above employ an outlet valve (or outlet valve assembly) which maintains the pressure stored in the device reservoir at a generally constant level, the operation of the device is generally independent of temperature; thus the device mitigates the problems of temperature-dependent energy release shown by prior art pressure accumulating devices.

Referring now to FIGS. 24 and 25, these respectively show a modified version of the outlet valve assembly shown in FIGS. 15–17, in its 'closed' configuration, and an enlarged fragmentary view of the valve assembly in its 'open' configuration. In FIGS. 24 and 25 those parts of the modified outlet valve assembly which correspond to parts of the outlet valve assembly of FIGS. 15–17 are given the same reference numerals.

The essential difference in the modified assembly of FIGS. 24 and 25 with respect to the assembly of FIGS. 15–17 consists of the provision of an inturned lip 801 at the discharge end 197 of the device to prevent total ejection of the differential piston 200 from the discharge end 197 of the device body 190 upon opening of the beverage can (not shown in FIGS. 24 and 25) in which the device is emplaced. To enhance the piston-retentive properties of the lip modification 801, the chamfer 210 in the unmodified piston 200 (FIG. 17) may be omitted as particularly illustrated in FIG. 25. While certain modifications and variations have been described above, the invention is not restricted thereto, and other modifications and variations can be adopted without departing from the scope of the invention as defined in the appended claims.

I claim:

1. A device for generating a foaming dispersion of bubbles in a fluid at the exterior of said device, said device and the fluid located inside a container, and the fluid at the exterior of said device comprising a liquid having a gas dissolved therein, wherein said device comprises:

an internal chamber;

a first valve in fluid communication with said internal, said first valve being in a normally closed state and being responsive to a pressure of the fluid at the exterior of said device and changing from said closed state to a temporary open state to admit an amount of the fluid from the exterior of said device through said first valve and in to said internal chamber when the pressure of the fluid at the exterior of said device exceeds the internal pressure of said internal chamber by a first predetermined mount, thereby to establish a reserve of pressurized fluid within said internal chamber; and a second valve in fluid communication with said internal chamber and said reserve of pressurized fluid within said internal chamber, said second valve having an outlet including a flow-restricting portion and being in a normally closed state, said second valve changing from said closed state to an open state in response to said internal pressure of said internal chamber when said internal pressure of said internal chamber exceeds the pressure of the fluid at the exterior of said device by a second predetermined amount, to release at least a portion of said reserve of pressurized fluid from said internal chamber to pass outwardly into the fluid at the exterior of said device through said flow-restricting portion, said release of said at least it portion of said reserve of pressurized fluid from said internal chamber by said second valve and passage of said reserve of pressurized fluid through said flow-restricting portion into the fluid at the exterior of said device assisting in the generation of a foaming dispersion of bubbles in the fluid at the exterior of said device.

2. A device as claimed in claim 1, wherein said flow-restricting portion comprises at least one restricted orifice.

3. A device as claimed in claim 2, wherein said flow-restricting portion comprises at least one restricted orifice, and wherein said at least one restricted orifice is so dimensioned as to cause said gas dissolved in said liquid to come out of solution in the form of a plurality of foam-generating seed bubbles as a result of said fluid being jetted out of said orifice.

4. A device as claimed in claim 1, wherein said inlet valve comprises a poppet valve.

5. A device as claimed in claim 1, wherein said inlet valve comprises a duck bill valve.

6. A device as claimed in claim 1, wherein said inlet valve comprises a diaphragm having at least one slit therein, said diaphragm partly bounding said internal chamber and being substantially closed to the outward passage of fluid therethrough, said diaphragm being inwardly deformable by external pressure to open said at least one slit for the passage therethrough of fluid into said internal chamber.

7. A device as claimed in claim 1, wherein said outlet valve comprises a differential valve.

8. A device as claimed in claim 7, wherein said differential valve has the form of a plug having a chamber-facing inner area acted upon by the internal pressure of said internal chamber, and an outlet passage normally closed by said plug, said flow-restricting portion being formed in said outlet passage, said plug further having an exterior-facing outer area acted upon by the pressure of the fluid surrounding the exterior of said device, said outer area being greater than said inner area by an extent which maintains said outlet passage plugged until said internal pressure of said internal chamber exceeds the pressure of said surrounding fluid by said second predetermined amount, thereupon to cause or allow said outlet passage to come unplugged to release said reserve of pressurized fluid from said internal chamber.

9. A device as claimed in claim 8, wherein said flow-restricting portion comprises at least one restricted orifice.

10. A device as claimed in claim 1, wherein said fluid which said first valve is adapted to admit into said internal chamber is derived from the inside of a container in which said device is placed.

11. A device as claimed in claim 10, wherein said fluid which said first valve is adapted to admit into said internal chamber is a liquid.

12. A device as claimed in claim 11, wherein said liquid has gas dissolved therein.

13. A method of packaging a beverage having a gas dissolved therein in a sealed container for subsequent generation of a foaming dispersion of bubbles in said beverage upon said container being opened, wherein said method comprises the steps of:

providing a sealable beverage container which is initially open, the interior of which provides a primary chamber;

providing a device comprising:

a secondary chamber;

a first valve in fluid communication with said secondary chamber in a normally closed state, said first valve being responsive to the pressure of a fluid at the exterior of said device and changing from said closed state to an open state to admit an amount of the fluid from the exterior of said device through said first valve and in to said secondary chamber when the pressure of fluid at the exterior of said device exceeds the internal pressure of said secondary chamber by a first predetermined amount, thereby to establish a reserve of pressurized fluid within said secondary chamber; and a second valve in fluid communication with said secondary chamber and said reserve of pressurized fluid within said secondary chamber, said second valve having an outlet including a flow-restricting portion and being in a normally closed state, said second valve being responsive to said internal pressure of said secondary chamber and changing from said closed state to an open state to release at least a portion of said reserve of pressurized fluid from said secondary chamber to pass outwardly into said liquid at the exterior of said device through said flow-restricting portion when said internal pressure of said secondary chamber exceeds the pressure of said liquid at the exterior of said device by a second predetermined amount;

placing said device in said primary chamber of said container;

prior or subsequent to placing said device in said open container, introducing said beverage in to said primary chamber;

closing and sealing said container;

pressurizing the contents of said primary container above the internal pressure of said secondary chamber by at least said first predetermined amount, thereby causing an amount of fluid from said primary chamber to be admitted through said first valve of said device and into said secondary chamber to establish a reserve of pressurized fluid within said secondary chamber; and forcing out at least a portion of said reserve of pressurized fluid from said secondary chamber into said beverage in said primary chamber through said flow-restricting portion of said second valve to assist in the generation of a foaming dispersion of bubbles in said beverage, when said container is subsequently opened to depressurise the contents of said primary chamber to a pressure below the internal pressure of the secondary chamber by at least said second predetermined amount.

14. A method as claimed in claim 13, wherein said amount of fluid admitted from said primary chamber to said secondary chamber is said beverage.

15. A method as claimed in claim 13, wherein said step of pressuring of the contents of said primary chamber is achieved, at least in part, by raising the temperature of said contents during pasteurization once said container has been sealed.

16. A method as claimed in claim 13, further comprising the step of purging said secondary chamber of oxidizing gases prior to said step of placing said device in said container.

17. A beverage package comprising:

a closed and sealed container forming a primary chamber which contains a quantity of beverage having a gas dissolved therein; and a device located in said primary chamber for generating a foaming dispersion of bubbles in the beverage, wherein said device comprises:

an internal, secondary chamber;

a first valve in fluid communication with said secondary chamber, said first valve being in a normally closed state and changing from said closed state to a temporary open state for admitting an amount of fluid from the exterior of said device through said first valve and into said secondary chamber when the pressure in said primary chamber exceeds the pressure in said secondary chamber by a first predetermined amount, thereby establishing a reserve of pressurized fluid within said secondary chamber; and a second valve in fluid communication with said secondary chamber and said reserve of pressurized fluid within said secondary, chamber, said second valve having an outlet including a flow-restricting portion and being in a normally closed state, said second valve being responsive to said internal pressure of said secondary chamber and changing from said closed state to an open state for releasing at least a portion of said reserve of pressurized fluid from said secondary chamber into said beverage in said primary chamber through said flow-restricting portion when said internal pressure of said secondary chamber exceeds the pressure in said primary chamber by a second predetermined amount, said release of at least a portion of said reserve of pressurized fluid from said secondary chamber by said second valve and passage of said reserve of pressurized fluid through said flow-restricting portion into said liquid at the exterior of said device assisting in the generation of a foaming dispersion of bubbles in the liquid at the exterior of said device.

18. A beverage package as claimed in claim 17, wherein said flow-restricting portion comprises at least one restricted orifice.

19. A beverage package as claimed in claim 17, wherein said beverage is a fermented beverage containing dissolved carbon dioxide as a product of fermentation.

20. A beverage package as claimed in claim 17, wherein said container is a can having a one-piece body of a metal chosen from the group consisting of deep-drawn aluminum or steel, an initially separate top end disc also of a metal chosen from the group consisting of aluminum or steel, and said top end disc closing said body and incorporating a manually operable pull ring and an integral closure tab defined by coining of the top end disc, said tab being attached to said manually operable pull ring for partial or total separation of the tab from the top end disc to unseal and open the filled can, said can being closed and sealed by seaming of the top end disc to the rim of the body.

21. A beverage package as claimed in claim 17, wherein said inlet valve comprises a diaphragm having at least one slit therein, said diaphragm partly bounding said secondary chamber and being substantially closed to the outward passage of fluid therethrough, said diaphragm being inwardly deformable by external pressure to open said at least one slit for the passage therethrough of fluid into said secondary chamber.

22. A beverage package as claimed in claim 17, wherein said outlet valve comprises a differential valve.

23. A beverage package as claimed in claim 22, wherein said differential valve has the form of a plug having a chamber-facing inner area acted upon by the internal pressure of said secondary chamber, and an outlet passage normally closed by said plug, said flow-restricting portion being formed in said outlet passage, said plug further having an exterior-facing outer area acted upon by the pressure of said fluid surrounding the exterior of said device, said outer area being greater than said inner area by an extent which maintains said outlet passage plugged until said internal pressure of said secondary chamber exceeds the pressure of said surrounding fluid by said second predetermined amount, thereupon to cause or allow said outlet passage to come unplugged to release said reserve of pressurized fluid from said secondary chamber.

24. A device as claimed in claim 23, wherein said flow-restricting portion comprises at least one restricted orifice.

* * * * *